US006125515A

United States Patent [19]

Boliek et al.

[11] Patent Number: 6,125,515

[45] Date of Patent: Oct. 3, 2000

[54] METHOD FOR BEAMING ELASTOMERIC FIBERS

[75] Inventors: John Ernest Boliek, Hockessin, Del.; Klaus Joachim Regenstein, Karben, Germany

[73] Assignee: E. I. du Pont de Nemours and Company, Wilmington, Del.

[21] Appl. No.: 09/357,755

[22] Filed: Jul. 21, 1999

[51] Int. Cl.[7] ..... B65H 54/00

[52] U.S. Cl. ..... 28/190; 28/194

[58] Field of Search ..... 28/190, 194, 172.2, 28/240, 241, 245, 185

[56] References Cited

U.S. PATENT DOCUMENTS

| | | | |
|---|---|---|---|
| 2,801,735 | 8/1957 | Wescott | 28/194 |
| 4,525,905 | 7/1985 | Bogucki-Land | 28/185 |
| 5,223,197 | 6/1993 | Boles et al. | 28/190 |
| 5,229,060 | 7/1993 | Knox et al. | 28/190 |

FOREIGN PATENT DOCUMENTS

| | | |
|---|---|---|
| 9-194892 | 7/1997 | Japan . |

*Primary Examiner*—Amy B. Vanatta
*Attorney, Agent, or Firm*—George A. Frank

[57] ABSTRACT

A method for winding elastomeric fibers at a predetermined beam-stretch by stretching the fibers to 35–75% of their elongation-to-break value.

10 Claims, No Drawings

METHOD FOR BEAMING ELASTOMERIC FIBERS

BACKGROUND OF THE INVENTION

1. Field of the Invention

This invention relates to a method of beaming elastomeric fibers onto a beam at high stretch and, more specifically, to a method where the beam stretch is about 200–400% absolute which is about 35%–75% of the elongation-to-break of the fibers.

2. Discussion of Related Art

Certain types of fabrics, for example warp knits and wovens, require that at least one of the fibers used to make the fabric be wound ("warped") onto beams from which they will be later unwound during the knitting or weaving process. The warp in such knits and wovens can be an elastomeric fiber.

During beaming of elastomeric fibers from a creel of fiber packages, it is customary during knitting and weaving to stretch the fibers slightly in order to remove them from the packages and to maintain sufficient fiber tension for easier handling. Such traditional stretching is generally in the range of about 10%–210%. The stretch on the beam ("beam stretch") which is customarily applied during commercial operations is generally in the range of about 25–105%. U.S. Pat. No. 4,525,905 discloses 80% pre-stretch (a constant extension between payout rollers and tension rollers) and 40% beam-stretch. Japanese Patent Application JP09-194892, filed Jul. 4, 1997, discloses pre-stretch of 250–500% and 50–130% beam-stretch.

However, fabrics, for example warp-stretch wovens and warp knits, made from beams of elastomeric fibers prepared according to the prior art have relatively high "power"; that is, they do not stretch easily. To obtain the low power desired for more comfortable garments, the knitting tension of the elastomeric fiber must be lowered, but lower stretch and higher spandex content also result. Higher knitting tension can be used to increase stretch and reduce spandex content but this would put undesirable strain on the knitting needles, thus shortening the needles' useful life, and the knitting machine must be operated more slowly.

A method of preparing fabrics with "easy" stretch (low power) and high stretch without deleteriously affecting equipment is still needed.

SUMMARY OF THE INVENTION

The method of the present invention is a method of winding a plurality of elastomeric fibers onto a warper beam at a predetermined beam-stretch, comprising the steps of:

(a) removing the fibers from packages on which the fibers are wound;

(b) stretching the fibers to a beam stretch of about 35%–75% of their elongation-to-break value; and (c) winding the stretched fibers onto the beam.

The invention also provides beams of elastomeric fibers made by the invention and warp-stretch woven and knit fabrics made from such beams.

DETAILED DESCRIPTION OF THE INVENTION

The term "elastomeric fibers", as used herein, means a continuous filament which has a break elongation in excess of 100% and which when stretched and released, retracts quickly and forcibly to substantially its original length. Such fibers include spandex (elastane), polyetherester fibers, and the like and can be processed into fabrics in bare or covered form. Either form can be used in the present invention; bare elastomeric fibers are preferred, and bare spandex is more preferred.

Fabric load power is used herein as a measure of the flatness of the stress-strain curve of the fabric. Generally, low load power corresponds to a flat stress-strain curve and, therefore, to easy stretch, which is desirable in today's active apparel.

Two descriptions of stretch are used herein. Absolute stretch means the actual stretch applied to the elastomeric fibers. Stretch as a percent of elongation-to-break is a relative measure that permits comparisons of the stretch applied to fibers having differing elongations-to-break.

It has now been found that highly stretching the elastomeric fibers as they are wound onto the beam (that is, applying high beam-stretch) results in fabrics with lower load power, even when low tension is used during knitting. Such beam-stretch can be applied in one or more steps before the fibers are wound onto the beam. Thus, beam-stretch can be applied in a single step directly from the beaming creel, but it is preferred that it be applied in two steps, for example, stretching at least to within about 200% absolute stretch less than the intended beam-stretch between the beaming creel and the rolls, and then completing the beam-stretch between the rolls and the beams. For example, if the desired beam-stretch is 400% absolute, the stretch in the first step can be about 200%–400% absolute. If the stretch during the second step is more than about 200% absolute stretch higher than that achieved in the first step, the beneficial effects of the first step can be diminished, and pressure on the beam can become undesirably high.

It has also now been found that highly pre-stretching the elastomeric fiber (for example, between the creel and the rolls) in combination with high beam-stretch has the additional advantage of reducing the pressure the elastomeric fiber exerts on the beam.

As used herein, "pre-stretch" means an optional stretch which is greater than the beam-stretch so that the fibers are stretched and then relaxed to the intended beam-stretch before they are wound onto the beam. Pre-stretch is applied between the beaming creel and the rolls. It should be understood that when pre-stretch is applied, then beam stretch cannot be applied in the two-step fashion described above. Use of pre-stretch is the most preferred process of the present invention.

Pre-stretch, by definition, must exceed the beam-stretch but not by more than about 200% absolute stretch. If the pre-stretch is greater than the beam stretch by more than about 200% absolute stretch, the forces on the warper can become unbalanced. That is, the retractive force between the creel on which the packages of elastomeric fiber are mounted and the rolls can become excessive compared to the force between the rolls and the beam which is being wound, and the mechanical integrity of the warper can be threatened.

High pressure on the beam can present safety problems because the beam might fail catastrophically. It can also become difficult to remove the somewhat tacky elastomeric fiber from the beam. The process steps of high pre-stretch or two-step beam stretch can alleviate such problems, especially with very high beam-stretch.

The beam-stretch utilized in the method of the present invention is about 35%–75%, preferably, about 45%–60%, of the elongation-to-break value of the elastomeric fiber. For example, Lycra® Type 902C spandex (a registered trademark of E. I. du Pont de Nemours and Company), which has an elongation-to-break value of about 700%, can be used in the present invention at a beam-stretch of about 245%–525% absolute stretch, preferably about 315%–420% absolute stretch.

In a preferred embodiment of the present invention, the pre-stretch applied in combination with beam-stretch is about 35%–75%, more preferably 45%–60%, of the elongation-to-break of the elastomeric fiber. For example, Lycra® Type 162B, which has an elongation-to-break value of about 450%, can be used in the present invention at a pre-stretch of about 160%–340%, preferably about 200%–270%. When pre-stretch is applied, the fibers must be given time to relax at least to the beam-stretch, which requires a certain distance between the pre-stretch rolls and the beam. In this case, the higher the difference between the pre-stretch and the beam-stretch, the greater the time and distance that are required between the rolls and the beam in order to allow the fibers to relax. The higher the speed at which the beam is being wound, the greater the distance required for the relaxation zone.

EXAMPLES

In the Examples, the warper was a Model 22E warper (American Liba, Inc., Piedmont, S.C.). 1340 ends of Lycra® spandex were warped onto High-Strength No. 21TN42 forged beams (available from Briggs-Shaffner Co., Winston-Salem, N.C.) at 50 or 100 yards per minute (46 or 91 meters per minute) creel speed using a flat lease. Stretch was applied by operating the pre-stretch rolls and beam at the appropriate relative revolutions per minute (rpm). The warping speed was limited by the high stretch used and the top speed of the motors; in commercial operation, refitting the warper with higher speed motors can allow for higher warping speeds. The creel was a rolling takeoff Model 6 from American Liba. The beams were 42 inches (107 cm) wide and had 21 inch (53 cm) flanges. The left, middle, and right circumferences of each beam were measured and found to be substantially the same.

Using sets of three beams, knitting was done on a RACOP Model 4E 64-gauge Raschel knitting machine having compound needles and a 126 inch (320 cm) knitting width, also made by American Liba. No difficulties were observed in removing the spandex from the beams. The warp was 100% bare spandex. The non-elastomeric fiber was 40 denier (44 decitex) 13-filament Type 865 Antron® nylon (a registered trademark of E. I. du Pont de Nemours and Company). The nylon runner length was 62.5 inches (158.8 cm) in all Examples. The fabrics were a standard Jersey Tricot construction, the nylon being knit as 2-3/1-0 (in warp knit chain notation) and the spandex being knit as 1-0/1-2.

The greige fabrics were finished by heat-setting on a three-box Krantz pin frame dryer designed to be steam-heated up to 250° F. and electrically heated above 250° F. Heat-setting conditions were 380° F. (193° C.) for 30 seconds with 10% overfeed at 5% over the natural width. "Weight percent" of bath ingredient refers to the weight of ingredient expressed as a percent of the weight of the fabric. "Grams per liter" of bath ingredient refers to the weight of the ingredient per liter of bath fluid.

Dyeing was performed in an Hisaka Model H horizontal jet dyeing machine. The dyeing procedures were different for the two types of Lycra® spandex used in the Examples, as described hereinafter.

Fabric containing Lycra® Type 162B was placed in a bath set at 100° F. (38° C.). The bath temperature was raised to 180° F. (82° C.) at a rate of 5° F. (2.8° C.)/minute, and then 15 g/l Polyclear NPH (a reductive clearing agent, Henkel Company) and 5 g/l sodium metabisulfite were added. The machine was run for 30 minutes, and then the bath was cooled to 170° F. (77° C.) and "cleared". ("Cleared" means that fresh water was passed through the bath containing the fabric until the exit stream was free of added reagents and dye.) The bath was set at 80° F. (27° C.) with 0.5 wt % Albegal B (a non-foaming leveling agent, Ciba Specialty Chemicals), and the machine was run for 5 minutes. The pH was adjusted to 5.5–6.0 with acetic acid, and the machine was run for another 5 minutes. 1.0 wt % of nylanthrene Bright Blue 2RFF dye (Crompton and Knowles) was added, and the machine was run for another 5 minutes. The bath temperature was raised to 210° F. (99° C.) at 3° F. (1.7° C.) per minute, and the machine was then run for 60 minutes. The bath was cooled to 170° F. (77° C.), the pH was slowly adjusted to 5.0 (if necessary) to exhaust the bath, and then the bath temperature was raised to 212° F. (100° C.) at 3° F. (1.7° C.) per minute and the machine was run for 30 minutes. The bath was then cooled again to 170° F. (77° C.) and cleared.

Fabric containing Lycra® Type 902C was placed in the bath, which was set at 180° F. (82° C.) with 15 g/l Polyclear NPH and 5 g/l sodium metabisulfite. The machine was run for 30 minutes and then cleared. The bath was set at 100° F. (38° C.), and 0.5 wt % Merpol® DA (an ethoxylated hydrocarbon nonionic surfactant, E. I. du Pont de Nemours and Company) and 2.0 wt % monosodium phosphate were added. The bath was adjusted to pH 5.0–5.5 with acetic acid, and 3.0 wt % Phorwhite CL (an optical whitener; it is believed that Intrawhite CF, Crompton and Knowles, can be substituted for Phorwhite CL) and 0.004 wt % polycron Violet 2R dye (Bezjian Dye/Chemical, Inc.) were added. The bath was raised to 210° F. (99° C.) at 3° F. (1.7° C.) per minute, and the machine was then run for 30 minutes. The bath was cooled to 170° F. (77° C.), and cleared, and then the fabric was rinsed for 10 minutes at room temperature with 0.5 g/l citric acid.

Finally, all the fabrics were dried on a Krantz dryer without stretch at the heat-set width at 250° F. (121° C.).

Fabric power was tested according to the following procedure. A 3"×8" (7.6 cm×20.3 cm) rectangle was cut from the fabric; the long direction coincided with the machine (warp) direction of the fabric. The rectangle was folded in half to form a 3"×4" (7.6 cm×10.2 cm) doubled fabric which was then sewn one inch (2.5 cm) from the open end of the loop to form a 3"×3" (7.6 cm×7.6 cm) closed loop with one-inch (2.5 cm) flaps. Three test specimens were prepared for each fabric sample. Two steel rods were inserted through the sewn loop of fabric, and the rods were mounted in an Instron tensile tester (Canton, Ma.) so that when the tester was activated, the separating rods applied stress to the fabric loops. The specimens were cycled three times to 100% extension (twice the original length) at a rate of 1000% per minute. The load power was measured (in the machine direction) and recorded at 80% fabric extension.

Fabric stretch at 12 pounds (5.44 kg) stress was measured in the same manner as fabric power, except that the sample was cycled three times to 12 pounds (5.44 kg) stress instead of to 100% extension; the percent stretch was measured on the third cycle.

Example 1

Lycra® Type 902C spandex of 120 denier (133 decitex) was used. During beaming, the first-step stretch was 100% and the second-step stretch was 200%, for a total of 300%. The knitting tension of the spandex was 16 grams for each group of three ends. The knit fabric had a basis weight of 275 g/m$^3$ and a load power at 80% extension of about 1260 g/cm. The results are recorded as Sample 1 in Table I.

Example 2

Example 1 was repeated, but a pre-stretch of 400% was used. The results are shown as Sample 2 in Table I.

Example 3

Example 1 was repeated, but the first-step stretch was increased to 300% and the second-step stretch changed to 100%, for a total beam-stretch of 400%. The results are shown as Sample 3 in Table I.

Example 4 (Comparison)

Example 1 was repeated but with a pre-stretch of only 100% and a beam-stretch of 50%. The results are recorded as Sample 4 in Table I.

Additional Samples 5 through 8 (the last, not of the invention) were made and tested, with results as illustrated in Table I. Comparison samples are indicated by the abbreviation "comp".

Example 5

Lycra® Type 162B spandex of 40 denier (44 decitex) was used. During beaming, the first-step was 200% and the beam-stretch was 300%. The knitting tension of the spandex was 9 grams for each three ends. The knit fabric had a load power at 80% extension of about 740 g/cm. The results are recorded as Sample 9 in Table II.

Example 6 (Comparison)

Example 4 was repeated but with 130% pre-stretch and 40% beam-stretch. The results are shown as Sample 10 in Table II.

Example 7 (Comparison)

Example 4 was repeated but with 300% pre-stretch and 100% beam-stretch. The results are shown as Sample 11 in Table II.

TABLE I

| Sample | First Step or Pre-Stretch (absolute, %) | % of Eb | Beam-Stretch (absolute, %) | % of Eb | Spandex knitting tension, g/3 ends | Fabric power, g/cm(1) | Fabric weight, g/m$^2$ | Fabric stretch, %(1) |
|---|---|---|---|---|---|---|---|---|
| 1 | 100 | | 300 | 43 | 16 | 1256 | 275 | 226 |
| 2 | 400(2) | 57 | 300 | 43 | 16 | 1244 | 275 | 221 |
| 3 | 300 | | 400 | 57 | 16 | 1325 | 292 | 235 |
| 4(comp) | 100 | 14 | 50 | 7 | 16 | 1728 | 268 | 182 |
| 5 | 100 | | 300 | 43 | 28 | 1360 | 278 | 236 |
| 6 | 400(2) | 57 | 300 | 43 | 28 | 1279 | 285 | 228 |
| 7 | 300 | | 400 | 57 | 28 | 1198 | 285 | 229 |
| 4(comp) | 100 | 14 | 50 | 7 | 28 | 1406 | 305 | 223 |

(1) Measured in the machine (warp) direction.
(2) Pre-stretch

As can be seen from Table I, at low knitting tension (16 grams per three ends) two-step high beam-stretch (samples 1, 3, 5, 7) and the combination of high pre-stretch with high beam-stretch (samples 2 and 6) provided knit fabrics with desirably reduced power (and, surprisingly, higher stretch at constant load) compared to knits prepared from the comparison beams. At high knitting tension (28 grams per three ends) the fabrics made from the inventive beams exhibited reduced fabric weight as well as reduced power but, again surprisingly, fabric stretch was substantially unchanged.

TABLE II

| Sample | First Step (absolute, %) | % of Eb | Beam-Stretch (absolute, %) | % of Eb | Spandex knitting tension g/3 ends | Fabric power, g/cm(1) | Fabric stretch, %(1) |
|---|---|---|---|---|---|---|---|
| 9 | 200 | — | 300 | 7 | 9 | 737 | 224 |
| 10(comp) | 130 | 29 | 40 | 9 | 9 | 853 | 214 |
| 11(comp) | 300 | 67 | 100 | 22 | 9 | 968 | 217 |

(1) Measured in the machine (warp) direction.

From Table II it can be seen that two-step stretching to high beam-stretch (sample 9) results in desirably lower power fabric (and higher stretchability) than either low pre-stretch and low beam-stretch (sample 10) or high pre-stretch and low beam-stretch (sample 11). As in Table I, "comp" indicates comparison samples.

In Examples 8 and 9, 120 denier (133 dtex) Type 902C Lycra® spandex was used in Instron tensile tester simulations of pre-stretch, one-step beam stretch, and two-step beam stretch. In all cases, three fiber specimens were tested and the results averaged.

Example 8

To show the effect of pre-stretch on fiber tension, the specimens were stretched to 400% absolute and then relaxed to 300% absolute "beam-stretch", at which point the samples exhibited a tension of 4.6 grams, compared to a tension of 16.5 grams when samples were stretched directly to 300% absolute stretch in one step. Similarly, when the specimens were stretched to 500% absolute and then relaxed to 300% absolute "beam-stretch", the samples exhibited an even lower tension of 3.5 grams. Therefore, based on the results of such simulated beaming tests, pressure on a beam made at high pre-stretch plus high beam-stretch would be reduced compared to a beam made at high beam-stretch without high pre-stretch.

Example 9

To simulate one-step stretching, each specimen was stretched to 300% absolute stretch, and the tension was measured and reported in grams. To simulate two-step stretching, each specimen was stretched to an intermediate level of absolute stretch, held for one second, and then stretching was resumed, without relaxation, to 300% absolute stretch. The tension was measured and reported in grams. The results are shown in Table III:

TABLE III

| Sample | No. of steps | 1st-step stretch | 2nd-step stretch | Tension grams |
|---|---|---|---|---|
| 12 | 1 | 300% | n.a. | 17.6 |
| 13 | 2 | 100% | 300% | 16.0 |
| 14 | 2 | 200% | 300% | 15.0 |

The results show that a greater reduction in fiber tension resulted when two-step stretching was used instead of one-step stretching and, therefore, the pressure on the beam would be reduced.

What is claimed is:

1. A method of winding a plurality of elastomeric fibers onto a warper beam at a predetermined beam-stretch, comprising the steps of:

(a) removing the fibers from packages on which the fibers are wound;

(b) stretching the fibers to a beam stretch of about 35%–75% of the elongation-to-break value of the fibers; and (c) winding the stretched fibers onto the beam.

2. The method of claim 1 wherein step (b) is accomplished in two stretching steps wherein the first step stretches the fibers to within 200% absolute stretch but less than the beam-stretch.

3. The method of claim 1 wherein between steps (a) and (b) the fibers are pre-stretched to about 35%–75% of the elongation-to-break value of the fibers, wherein the pre-stretch is greater than the beam-stretch but by not more than about 200% absolute stretch.

4. The method of claim 2 wherein the beam-stretch is about 45%–60% of the elongation-to-break value of the fibers.

5. The method of claim 3 wherein the pre-stretch is about 45%–60% of the elongation-to-break value of the fibers.

6. The method of claim 1 wherein the elastomeric fibers are spandex.

7. Beams of elastomeric fibers made by the method of claim 1.

8. Warp-stretch fabrics made from the beams of claim 7.

9. The fabrics of claim 8 wherein the fabrics are woven fabrics.

10. The fabrics of claim 8 wherein the fabrics are knit fabrics.

* * * * *